US009033735B2

(12) United States Patent
Gaiser et al.

(10) Patent No.: US 9,033,735 B2
(45) Date of Patent: May 19, 2015

(54) CONTACT PLUG FOR DIRECTLY CONTACTING A CIRCUIT BOARD

(75) Inventors: Timo Gaiser, Niefern-Oeschelbronn (DE); Michael Schoenfeld, Leinfelden-Echterdingen (DE); Lars Berger, Moeglingen (DE); Michael Fleig, Tilburg (NL)

(73) Assignee: ROBERT BOSCH GMBH, Stuttgart (DE)

( * ) Notice: Subject to any disclaimer, the term of this patent is extended or adjusted under 35 U.S.C. 154(b) by 80 days.

(21) Appl. No.: 14/003,706

(22) PCT Filed: Feb. 9, 2012

(86) PCT No.: PCT/EP2012/052227

§ 371 (c)(1), (2), (4) Date: Nov. 13, 2013

(87) PCT Pub. No.: WO2012/119830

PCT Pub. Date: Sep. 13, 2012

(65) Prior Publication Data

US 2014/0057491 A1 Feb. 27, 2014

(30) Foreign Application Priority Data

Mar. 7, 2011 (DE) ..... 10 2011 005 173

(51) Int. Cl.

| | |
|---|---|
| ***H01R 13/40*** | (2006.01) |
| ***H01R 13/00*** | (2006.01) |
| ***H01R 12/87*** | (2011.01) |
| ***H01R 13/52*** | (2006.01) |
| *H01R 12/72* | (2011.01) |

(52) U.S. Cl.

CPC ..... *H01R 13/00* (2013.01); *H01R 12/721* (2013.01); *H01R 12/87* (2013.01); *H01R 13/5219* (2013.01)

(58) Field of Classification Search

CPC ..... H01R 13/00; H01R 12/721; H01R 12/87; H01R 13/5219

USPC ..... 439/587–589, 630, 636, 637, 660

See application file for complete search history.

(56) References Cited

U.S. PATENT DOCUMENTS 6,383,021 B1 * 5/2002 Murakami et al. ..... 439/587

(Continued)

FOREIGN PATENT DOCUMENTS

| | | |
|---|---|---|
| DE | 102005063239 | 6/2007 |
| DE | 102008054996 | 7/2010 |

OTHER PUBLICATIONS

International Search Report for PCT/EP2012/052227, issued on Jul. 13, 2012.

*Primary Examiner* — Khiem Nguyen

(74) *Attorney, Agent, or Firm* — Kenyon & Kenyon LLP

(57) ABSTRACT

A contact plug for direct electrical contacting of contact surfaces is provided on both sides of a circuit board. The contact plug includes two flexibly interconnected contact carriers, which form, between each other, a plug receptacle for the circuit board and each have at least one contact element extending into the plug receptacle. A spring is provided whose two free spring legs engage over the two contact carriers i the insertion direction of the contact plug and bias them in the direction of each other. A control channel, which is formed between the two contact carriers nd laterally adjacent to the plug receptacle and, in cooperation with a control wedge provided on the circuit board, pivots the two contact carriers open in opposition to the action of the spring upon insertion of the circuit board. A seal seals the two contact carriers in a mating contact plug on the reverse side. The two free spring legs of the springengage over the two contact carriers in the insertion direction of the contact plug. The seal is positioned between the contact carriers and the spring midsection of the spring, the two spring legs extending through the seal and being sealed at the seal.

5 Claims, 4 Drawing Sheets

(56) References Cited

U.S. PATENT DOCUMENTS 6,497,589 B1 * 12/2002 Hutchinson et al. ..... 439/460
6,722,922 B2 * 4/2004 Cykon et al. ..... 439/587
7,040,909 B2 * 5/2006 Cairns ..... 439/271
8,827,745 B2 * 9/2014 Tsujii et al. ..... 439/587
2011/0021078 A1 1/2011 Iida et al.

* cited by examiner

CONTACT PLUG FOR DIRECTLY CONTACTING A CIRCUIT BOARD

FIELD OF THE INVENTION

The present invention relates to a contact plug.

BACKGROUND INFORMATION

Control units in the automotive branch are mostly made up of a circuit board, on which electronic components are positioned, as well as a housing. In engine control units, a multipoint connector is normally mounted on the circuit board, in order to produce the electrical connection between a cable harness plug and the circuit board. Thus, the multipoint connector constitutes an additional component in the assembly of the control unit.

There are also so-called direct electrical contacts, in which the multipoint connector is omitted and the individual poles of the cable harness are directly contacted on the circuit board. To that end, electrical contact surfaces ("lands"), which are directly contacted by contact elements of the cable harness plug, are provided on the circuit board.

In the case of the direct contacting described in German Published Patent Application No. 10 2005 063 239, the contacting plug has two flexibly interconnected contact carriers, which are biased in the direction of each other by a V-shaped or U-shaped spring open in a direction opposite to the insertion direction of the contact plug. In the case of contact and mating contact plugs inserted into one another, the spring is situated completely in the sealed region of the contact plug, which means that its spring length is minimized, and consequently, its elastic spring characteristics are reduced.

SUMMARY

In contrast, in the case of a contact plug mentioned at the outset, an object of the present invention is to improve the elastic spring characteristics of the spring without enlarging the sealed region of the contact plug in the process.

According to the present invention, the spring is positioned with its midsection in the unsealed region, and extends through the seal with its two free spring legs, into the sealed region of the contact plug connection. Thus, the spring is no longer limited in its length by the seal, but obtains additional spring length without affecting the overall sealed space, which is as small as possible. The characteristic curve of the spring may be optimized, thus obtaining a greater operating range and functioning in both the sealed and unsealed regions of the contact plug. The spring is preferably a fastening spring or leg spring.

DETAILED DESCRIPTION

Figure 1:
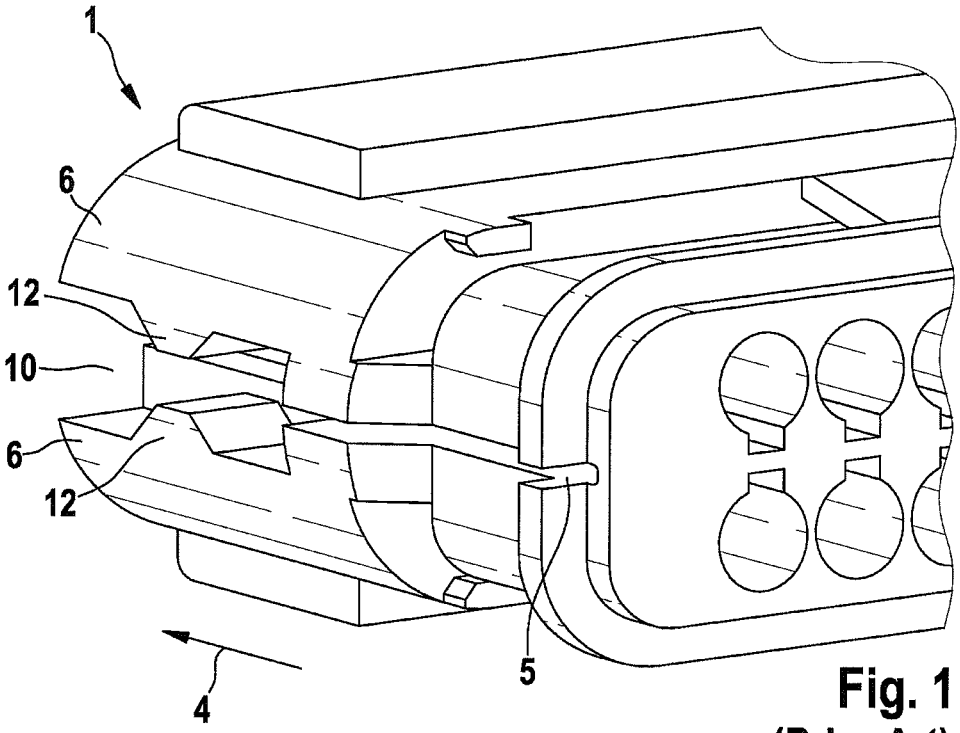
Fig. 1 (Prior Art)
FIG. 1 shows a perspective side view of a known contact plug.
Figure 2A:
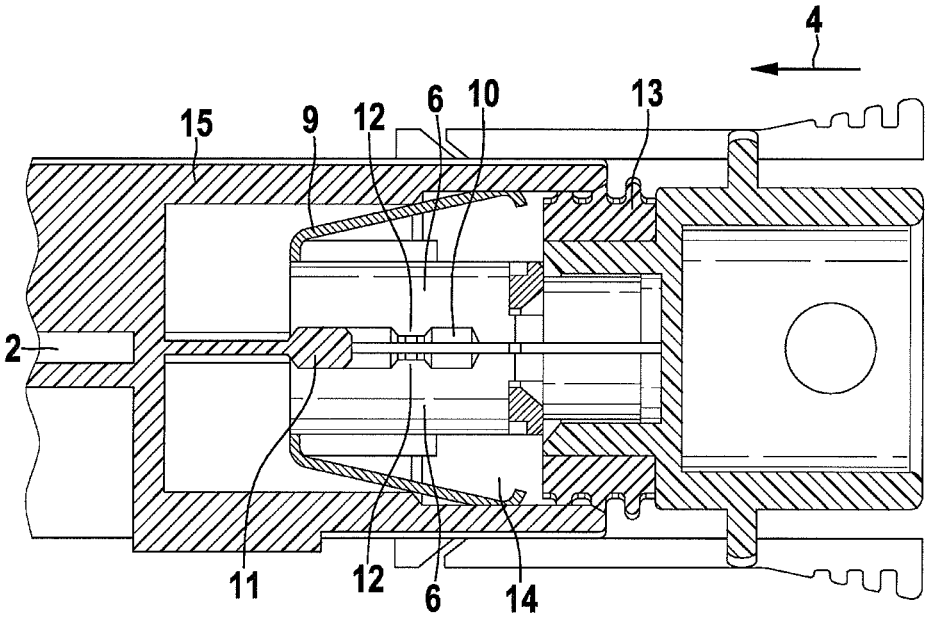
Fig. 2a (Prior Art)
FIG. 2*a*-2*d* show a longitudinal section of the contact plug connection described in German Published Patent Application No. 10 2005 063 239, which includes a mating contact plug, into which the contact plug of FIG. 1 is inserted partially (FIG. 2*a*, 2*b*), almost completely (FIG. 2*c*), and completely (FIG. 2*d*), with FIG. 2*a* showing a longitudinal section outside of the contact plug, and FIG. 2*b* through 2*d* showing a longitudinal section of the contact plug.
Figure 2B:
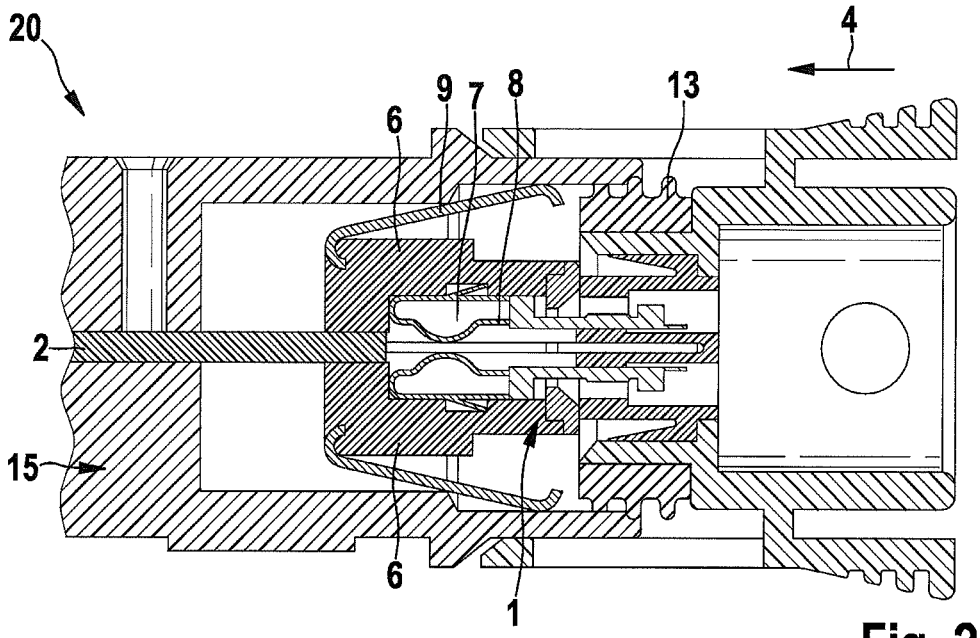
Fig. 2b (Prior Art)
Figure 2C:
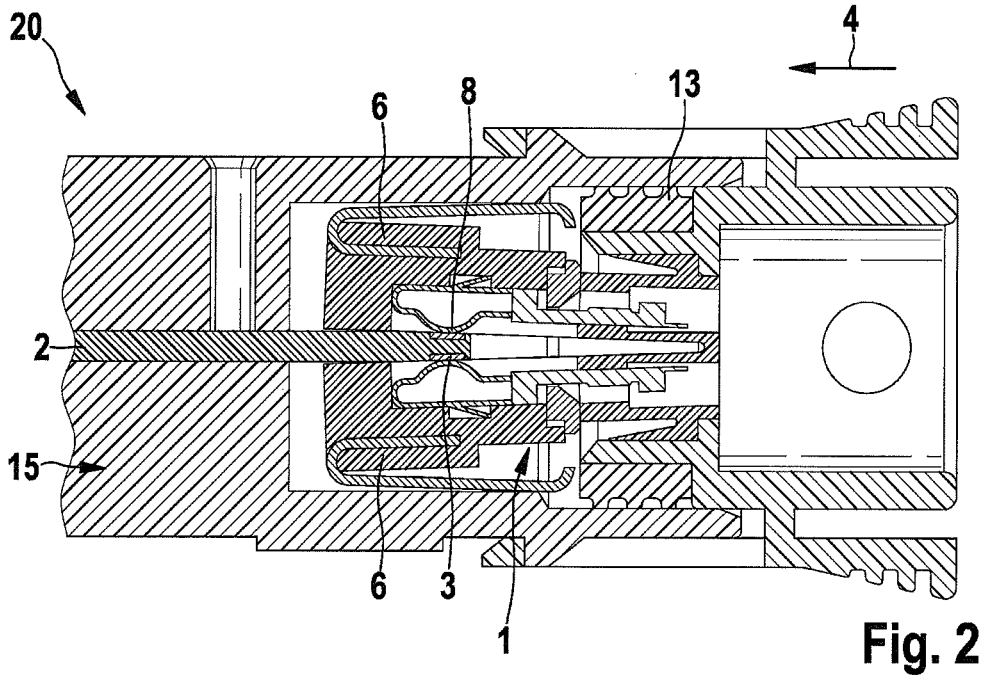
Fig. 2c (Prior Art)

The contact plug (e.g., cable harness plug) 1 shown in FIG. 1 is used for direct electrical contacting of contact surfaces ("lands") 3 provided on both sides of a circuit board 2 (FIG. 2*c*). The insertion direction of contact plug 1 is denoted by 4.

The contact plug 1 insertably connectible to circuit board 2 includes two contact carriers 6, which are, for example, flexibly interconnected by a film hinge 5, form, between one another, a plug receptacle 7 (FIG. 2*b*) for circuit board 2, and each have a row of elastic contact elements 8 extending into plug receptacle 7; a V-shaped or U-shaped spring (e.g., fastening spring or leg spring) 9, which is open in a direction opposite to insertion direction 4 and biases the two contact carriers 6 in a direction towards each other; as well as a control channel 10, which is formed between the two contact carriers 6 and laterally adjacent to plug receptacle 7 and, in cooperation with a control wedge 11 (FIG. 2*a*) provided on circuit board 2, pivots the two contact carriers 6 open in opposition to the action of spring 9, upon insertion of circuit board 2, and pivots them closed due to the action of spring 9. Control channel 10 is narrowed by two diametrically opposed control projections 12 of the two contact carriers 6. A seal 13 seals contact plug 1 with respect to the outside, in a plug socket 14 of a mating contact plug 15.

FIG. 2 shows a known contact plug connection 20 between contact plug 1 and mating contact plug 15.

FIG. 2*a*, 2*b* show the contact plug connection 20 including plugs 1, 14 partially inserted into one another. Control wedge 11 is situated in control channel 10, but does not yet interact with control projections 12. Circuit board 2 is situated between the two contact carriers 6, but does not yet interact with contact elements 8.

Figure 2D:
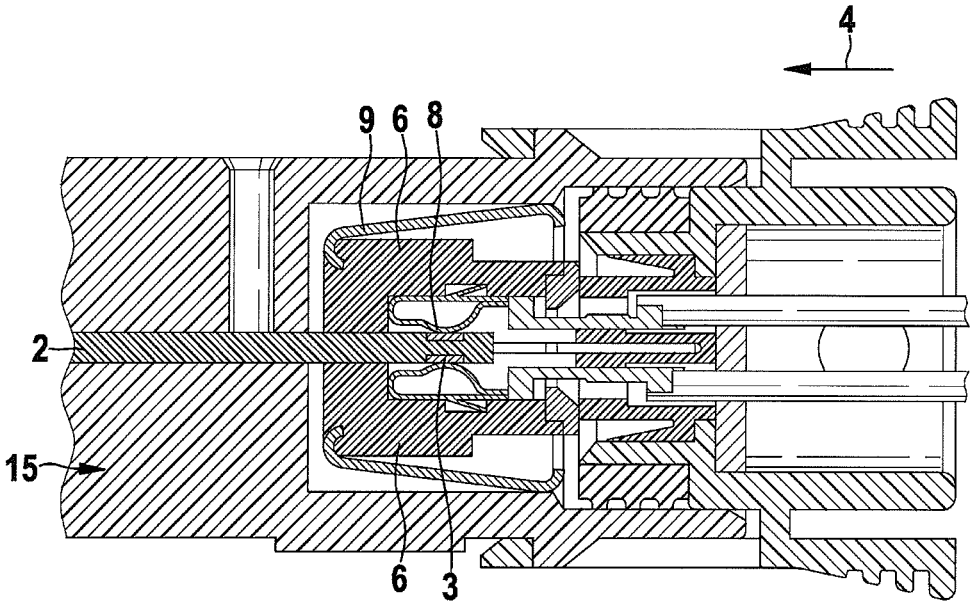
Fig. 2d (Prior Art)

Upon further insertion into one another, control wedge 11 runs into the two control projections 12, by which the two contact carriers 6 are spread apart from one another in opposition to the action of spring 9 and contact elements 8 are raised relative to circuit board 2 (FIG. 2*c*). When, upon further insertion into one another, control wedge 11 is then slid past control projections 12, the two contact carriers 6 pivot back again, due to spring 9. In this manner, contact elements 8 are lowered onto contact surfaces 3 of circuit board 2 and contact them in the final insertion position (FIG. 2*d*).

Figure 3:
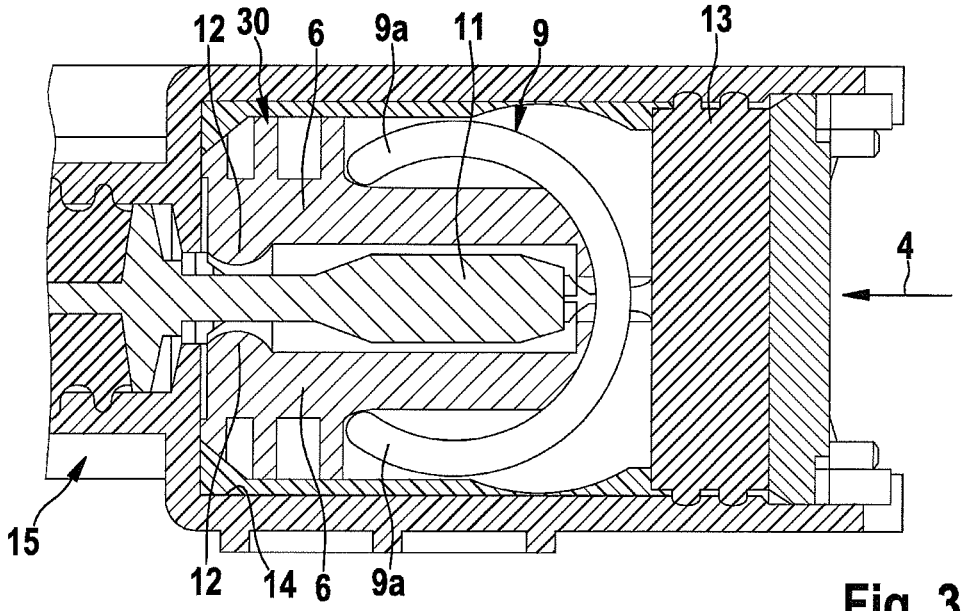
FIG. 3 shows a longitudinal section of a further contact plug, analogous to FIG. 2*a*.

FIG. 3 shows a further contact plug 30 in its final insertion position in mating contact plug 15. This contact plug 30 only differs from the contact plug 1 of FIGS. 1 and 2 in that, in this instance, spring 9 is formed to be round, is open in insertion direction 4 and engages over the two contact carriers 6 in insertion direction 4 with its two free spring legs 9*a*. In plug socket 14 of mating contact plug 15, the two contact carriers 6, together with spring 9, are sealed on the reverse side by seal 13. Due to the space sealed in a predefined manner, the spring length is reduced to a minimum, which means that spring 9 has almost no elastic spring action and is therefore very stiff.

Figure 4:
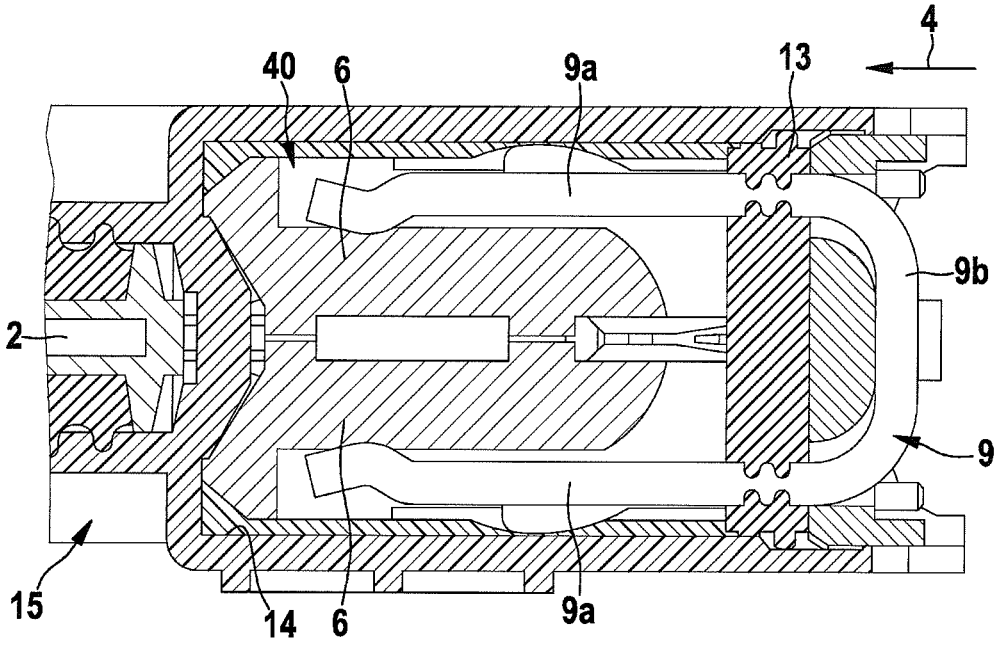
FIG. 4 shows the contact plug of the present invention, in a longitudinal section similar to FIG. 3, but in a plane between the circuit board and a control wedge.

The contact plug 40 shown in FIG. 4 only differs from contact plug 30 of FIG. 3 in that, in this instance, spring 9 is U-shaped and extends through seal 13 with its two spring legs 9*a*, in a sealed manner, while spring midsection 9*b* is situated outside of the sealed space of contact plug 40. In other words, seal 13 is situated between contact carriers 6 and spring midsection 9*b*. Unlike in FIG. 3, the spring length of spring 9 is no longer limited by the sealed space of the contact plug predetermined by seal 13, but spring 9 obtains additional spring length, and with it, higher elastic spring force, without enlarging the sealed space.

What is claimed is:

1. A contact plug for a direct electrical contacting of contact surfaces provided on both sides of a circuit board, comprising:

two flexibly connected contact carriers that form, between them, a plug receptacle for the circuit board, each contact carrier including at least one contact element extending into the plug receptacle;

a spring including two free spring legs for biasing the two contact carriers in a direction of one another;

a control wedge provided on the circuit board;

a control channel formed between the two contact carriers and laterally adjacent to the plug receptacle, wherein, in cooperation with the control wedge, the control channel pivots the two contact carriers open in opposition to an action of the spring, upon insertion of the circuit board;

a mating contact plug; and a seal that seals the two contact carriers in the mating contact plug, on a reverse side, wherein:

the two free spring legs of the spring engage over the two contact carriers in an insertion direction of the contact plug, the seal is situated between the contact carriers and a spring midsection of the spring, and the two free spring legs extend through the seal and are sealed at the seal.

2. The contact plug as recited in claim 1, wherein the spring is U-shaped.

3. The contact plug as recited in claim 1, wherein the two free spring legs of the spring are at least twice as long as the spring midsection.

4. The contact plug as recited in claim 1, wherein the spring includes one of a fastening spring and a leg spring.

5. A direct contact plug connection, comprising:

a contact plug that is for a direct electrical contacting of contact surfaces provided on both sides of a circuit board, the contact plug including:

two flexibly connected contact carriers that form, between them, a plug receptacle for the circuit board, each contact carrier including at least one contact element extending into the plug receptacle, a spring including two free spring legs for biasing the two contact carriers in a direction of one another, a control wedge provided on the circuit board, a control channel formed between the two contact carriers and laterally adjacent to the plug receptacle, wherein, in cooperation with the control wedge, the control channel pivots the two contact carriers open in opposition to an action of the spring, upon insertion of the circuit board, a mating contact plug, and a seal that seals the two contact carriers in the mating contact plug, on a reverse side, wherein:

the two free spring legs of the spring engage over the two contact carriers in an insertion direction of the contact plug, the seal is situated between the contact carriers and a spring midsection of the spring, and the two free spring legs extend through the seal and are sealed at the seal, the mating contact plug includes the circuit board and the control wedge, the spring midsection of the spring is situated outside of a region of the contact plug sealed by the seal, and the two free spring legs of the spring extend through the seal in a sealed manner, into the sealed region of the contact plug.

* * * * *